US005776541A

United States Patent [19]

Belt et al.

[11] Patent Number: 5,776,541

[45] Date of Patent: Jul. 7, 1998

[54] METHOD AND APPARATUS FOR FORMING AN IRREGULAR PATTERN OF GRANULES ON AN ASPHALT COATED SHEET

[75] Inventors: James S. Belt, Utica; Frank R. Wilgus, Powell; Frank A. Wilgus, Westerville, all of Ohio

[73] Assignee: Owens-Corning Fiberglas Technology, Summit, Ill.

[21] Appl. No.: 774,433

[22] Filed: Dec. 30, 1996

[51] Int. Cl.[6] ..... B05D 1/12; B05D 1/36

[52] U.S. Cl. ..... 427/186; 427/188; 427/199; 427/204; 239/518

[58] Field of Search ..... 427/186, 188, 427/199, 204; 118/324, 325, 327; 239/518, 522, 687

[56] References Cited

U.S. PATENT DOCUMENTS

| | | | |
|---|---|---|---|
| 83,718 | 7/1868 | Brown . | |
| 89,471 | 3/1869 | Streeter et al. . | |
| 93,191 | 8/1869 | Topping . | |
| 978,333 | 12/1910 | Overbury . | |
| 1,295,360 | 2/1919 | Overbury . | |
| 1,345,627 | 7/1920 | Overbury . | |
| 1,439,176 | 12/1922 | Loepsinger | 239/518 |
| 1,445,991 | 2/1923 | Butterick . | |
| 1,583,563 | 5/1926 | Abraham . | |
| 1,820,005 | 8/1931 | Maclean . | |
| 1,956,285 | 4/1934 | Harshberger . | |
| 2,111,761 | 3/1938 | Eckert . | |
| 2,112,819 | 3/1938 | Williford . | |
| 2,129,288 | 9/1938 | Shattuck . | |
| 2,175,226 | 10/1939 | Slayter . | |
| 2,316,093 | 4/1943 | MacNutt . | |
| 2,348,223 | 5/1944 | Papesh . | |
| 2,523,759 | 9/1950 | Grant . | |
| 2,676,155 | 4/1954 | Farris . | |
| 2,771,387 | 11/1956 | Kleist et al. . | |
| 3,332,830 | 7/1967 | Tomlinson et al. . | |
| 3,885,684 | 5/1975 | Mitchell | 214/17 |
| 3,919,823 | 11/1975 | Bradley . | |
| 4,233,100 | 11/1980 | Cunningham et al. . | |
| 4,274,243 | 6/1981 | Corbin et al. . | |
| 4,333,279 | 6/1982 | Corbin et al. . | |
| 4,359,873 | 11/1982 | Miller . | |
| 4,399,186 | 8/1983 | Lauderback . | |
| 4,468,430 | 8/1984 | Ruede . | |
| 4,583,486 | 4/1986 | Miller . | |
| 4,900,589 | 2/1990 | Montgomery | 427/188 |
| 5,186,980 | 2/1993 | Koschitzky . | |
| 5,405,647 | 4/1995 | Grubka et al. . | |
| 5,488,807 | 2/1996 | Terrenzio et al. . | |
| 5,520,889 | 5/1996 | Burton et al. . | |
| 5,547,707 | 8/1996 | Haubert et al. . | |

FOREIGN PATENT DOCUMENTS

| | | |
|---|---|---|
| 225020 | 7/1958 | Australia . |
| 2 118 072 | 10/1983 | United Kingdom . |

OTHER PUBLICATIONS

Ruberoid Co. Brochure, "Instructions For Laying 11 X 32 Inch Strip–Shingles", dated 1921.

*Primary Examiner*—Shrive Beck
*Assistant Examiner*—Fred J. Parker
*Attorney, Agent, or Firm*—C. Michael Gegenheimer; Ted C. Gillespie

[57] ABSTRACT

In a method of forming an irregular pattern of granules on an asphalt coated sheet, a flow of granules is discharged toward the sheet. The granules are deflected onto the sheet with a deflector having an irregular surface to form a granule deposit having an irregular pattern. In one embodiment of the method, the deflected granules are controlled with a shield. Apparatus for forming an irregular pattern of granules on an asphalt coated sheet includes a granule applicator for discharging a flow of granules, a deflector having an irregular surface for deflecting the granules, and optionally a shield for controlling the granules.

20 Claims, 6 Drawing Sheets

FIG. 11
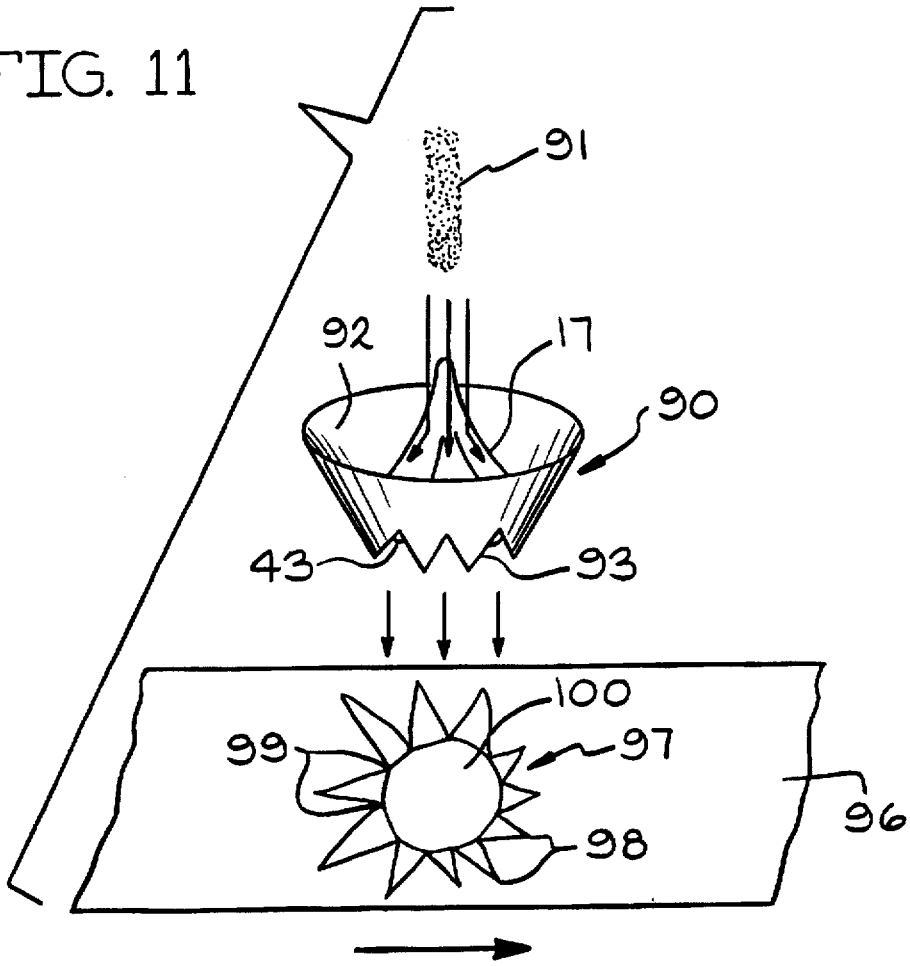
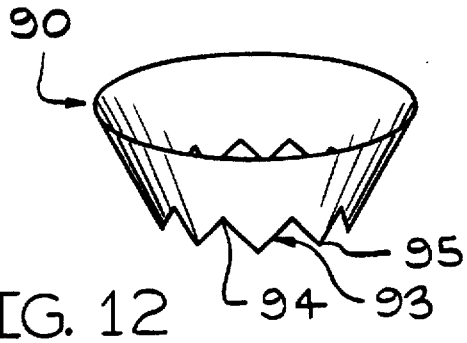
FIG. 12
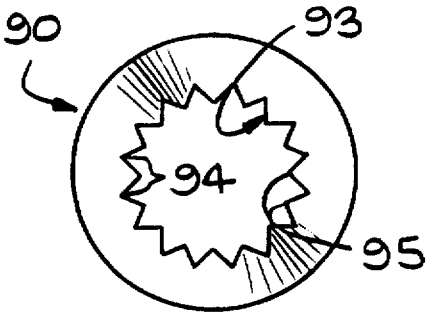
FIG. 13

METHOD AND APPARATUS FOR FORMING AN IRREGULAR PATTERN OF GRANULES ON AN ASPHALT COATED SHEET

CROSS-REFERENCE TO RELATED APPLICATIONS

This application is related to the following commonly filed and co-pending applications: U.S. application Ser. No. 08/774,432, filed Dec. 30, 1996, entitled "Method of Rotating or Oscillating a Flow of Granules to Form a Pattern on an Asphalt Coated Sheet", by Belt et al.; and U.S. application Ser. No. 08/781,898, filed Dec. 30, 1996, entitled "Method and Apparatus for Applying Granules to an Asphalt Coated Sheet to Form a Pattern having Inner and Outer Portions", by Belt et al..

TECHNICAL FIELD AND INDUSTRIAL APPLICABILITY

This invention relates in general to the handling of continuous sheets of asphalt material, such as asphalt material suitable for use as roofing shingles and roll roofing. More particularly, this invention relates to a method of deflecting a flow of granules onto an asphalt coated sheet to form an irregular pattern of granules on the sheet.

BACKGROUND OF THE INVENTION

A common method for the manufacture of asphalt shingles is the production of a continuous sheet of asphalt material followed by a shingle cutting operation which cuts the material into individual shingles. In the production of asphalt sheet material, either a glass fiber mat or an organic felt mat is passed through a coater containing hot liquid asphalt to form a tacky, asphalt coated sheet. Subsequently, the hot asphalt coated sheet is passed beneath one or more granule applicators which discharge protective surface granules onto portions of the asphalt sheet material.

In the manufacture of colored shingles, two types of granules are typically employed. Headlap granules are granules of relatively low cost used for the portion of the shingle which will be covered up on the roof. Colored granules or prime granules are of relatively higher cost and are applied to the portion of the shingle which will be exposed on the roof.

To provide a color pattern of pleasing appearance, the colored portion of the shingles may be provided with areas of different colors. Usually the shingles have a background color and a series of granule deposits of different colors or different shades of the background color. The term "blend drop", as used herein, refers to the flow of granules of different colors or different shades of color that is discharged from a granule applicator toward the asphalt coated sheet. The term "granule deposit", as used herein, refers to the blend drop of granules after it has been deposited on the sheet.

A common method for manufacturing the shingles is to discharge blend drops onto spaced areas of the tacky, asphalt coated sheet. Background granules are then discharged onto the sheet and adhere to the tacky, asphalt coated areas of the sheet between the granule deposits formed by the blend drops.

One of the problems with typical granule application equipment is that it depends on mechanical movement to discharge blend drops onto the moving asphalt coated sheet. Usually the granules are fed from a hopper onto a fluted roll from which, upon rotation, the granules are discharged onto the sheet. The roll is ordinarily driven by a drive motor, and the roll is positioned in the drive or non-drive position by means of a brake-clutch mechanism. The requirement for mechanical action has inherent limitations which prevent a very precise beginning and ending to the blend drop. Also, once the mechanical action takes place, there is a short time lag as gravity takes effect on the granules and they drop onto the moving asphalt coated sheet. Consequently, there is a limit to the sharpness of the granule deposits on the shingle. As shingle manufacturing lines go up in speed, the lack of sharpness is accentuated and the distinction between the granule deposits and the background color becomes fuzzy. The lack of sharpness puts a severe limitation on the kinds of patterns and color contrasts which can be applied to shingles at high production speeds.

One method for manufacturing shingles having sharply defined granule deposits involves the application of the background color granules over the entire exposed tacky surfaces of the shingles. Adhesive such as hot asphalt is then applied in a pattern on top of the background color granules on the sheet, in the areas where the granule deposits are to be applied. Then the granule deposits are applied and adhere to the shingle only on the areas of adhesive. This method of applying granules is described in U.S. Pat. No. 4,352,837, issued Oct. 5, 1982 to Kopenhaver. Unfortunately, the application of the double layer of granules in the areas of granule deposits make these shingles relatively expensive, heavy and inflexible.

A recently developed improved method for discharging blend drops onto the moving asphalt coated sheet uses an apparatus known as a pneumatic blender. This apparatus employs a pneumatic gating mechanism to provide a relatively high degree of precision in discharging the blend drops. The flow of granules is started, stopped and controlled by providing pneumatic pressure changes in a buffer chamber positioned adjacent an accumulation of granules in a granule nozzle. When the pneumatic pressure is increased, the flow of granules is ejected under pressure onto the moving asphalt coated sheet instead of dropping solely by gravity. These features of the pneumatic blender allow more sharply defined granule deposits to be formed on the moving asphalt coated sheet. A preferred pneumatic blender is disclosed in U.S. Pat. No. 5,520,889, issued May 28, 1996 to Burton et al. (incorporated by reference herein).

Other improvements have also been made in methods of applying granule deposits. For example, U.S. Pat. No. 5,405,647, issued Apr. 11, 1995 to Grubka et al., discloses a method for applying granules to a moving asphalt coated sheet to form areas having sharp leading and trailing edges. However, it would still be desirable to provide a method for making a variety of unique and attractive patterns of granule deposits on asphalt coated sheets. Granule deposits applied by typical methods are usually formed in a regular pattern such as a rectangular pattern on the sheet. It would be desirable to provide a method and apparatus for forming irregular patterns of granules on the sheet. It would also be desirable to provide irregular patterns without the drawbacks of applying a double layer of granules on the sheet.

SUMMARY OF THE INVENTION

The above objects as well as other objects not specifically enumerated are achieved by a method of forming an irregular pattern of granules on an asphalt coated sheet. In the method, a flow of granules is discharged toward the sheet. The granules are deflected onto the sheet with a deflector having an irregular surface to form a granule deposit having an irregular pattern. In one embodiment of the method, the granules are controlled with a shield. Apparatus for forming an irregular pattern of granules on an asphalt coated sheet includes a granule applicator for discharging a flow of granules toward the sheet. A deflector is provided for deflecting the granules onto the sheet. The deflector has an irregular surface to form a granule deposit having an irregular pattern. The apparatus can also include a shield for controlling the granules.

BRIEF DESCRIPTION OF THE DRAWINGS

FIG. 11 is a perspective view of a deflector having an irregular surface to deflect granules, positioned inside a shield having an irregular opening to control the granules, to form an irregular pattern on an asphalt coated sheet according to the invention.

FIG. 12 is a perspective view of the shield of FIG. 11.

FIG. 13 is a top plan view of the shield of FIG. 11.

DETAILED DESCRIPTION AND PREFERRED EMBODIMENTS

Figure 1:
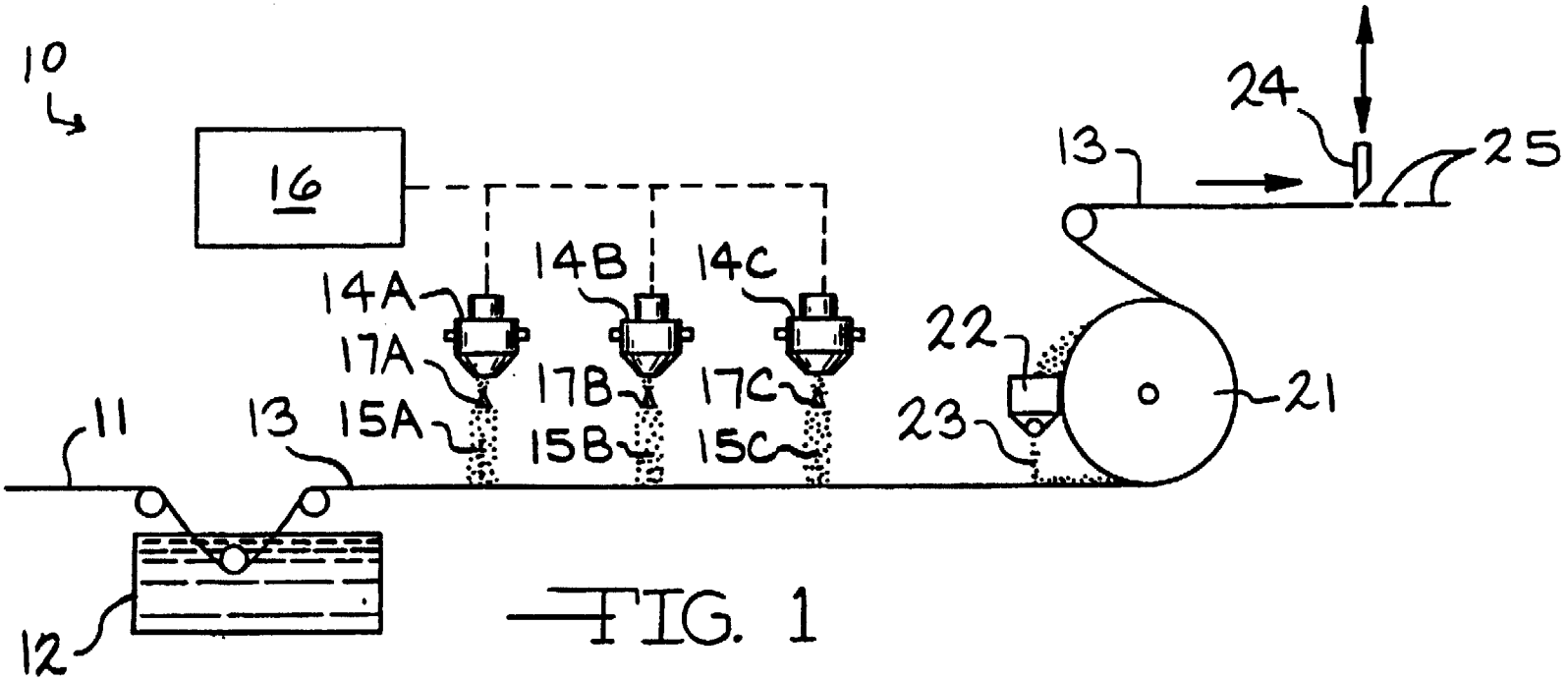
FIG. 1 is a schematic view in elevation of apparatus for forming irregular patterns of granules on a moving asphalt coated sheet according to the invention.

Referring now to the drawings, FIG. 1 illustrates a portion of apparatus 10 for manufacturing roofing shingles according to a preferred embodiment of the invention. While the invention will be described in relation to roofing shingles, it should be understood that the invention is applicable to any type of asphalt sheet material, such as roll roofing, roofing shingles with or without cutouts, or other forms of asphalt sheet material.

In the illustrated embodiment, a continuous sheet 11 of a glass fiber mat or an organic felt mat is passed through a coater 12 containing hot, liquid asphalt material. This produces a tacky, asphalt coated sheet 13.

The sheet then passes beneath a series of granule applicators 14A, 14B and 14C, which will be described in more detail below. The granule applicators periodically discharge blend drops 15A, 15B and 15C of granules toward the sheet. The granule applicators can be mounted above the sheet in any suitable manner.

The granule applicators can be controlled by a controller 16. Any type of controller can be used, such as a computer or similar device.

Preferably, the controller is programmable so that instructions can be entered for repeatably producing the blend drops, and for coordinating the discharge of blend drops from the different granule applicators. Depending on the desired pattern of granule deposits, the granule applicators can be sequenced on and off, and they can be programmed differently or the same. Also, the position of the granule applicators relative to the prime portion of the sheet can be different or the same. The frequency of discharge from the granule applicator at a given line speed can also be adjusted, depending on the desired frequency of the pattern of granule deposits.

Figure 2:
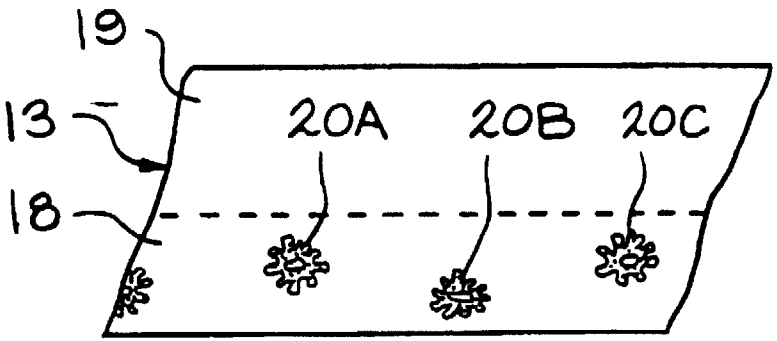
FIG. 2 is a schematic plan view of a portion of an asphalt coated sheet having irregular patterns of granules formed thereon according to the invention.

The blend drops 15 of granules are deflected onto the sheet with deflectors 17A, 17B and 17C which will be described in detail below. As shown in FIG. 2, the sheet 13 includes a prime portion 18 and a headlap portion 19. Some of the deflected granules adhere to the tacky asphalt coating on the prime portion of the sheet, and form granule deposits 20A, 20B and 20C having an irregular pattern. The granule deposits can be formed in a staggered or random pattern as shown, or a more uniform pattern. Some of the deflected granules do not adhere to the sheet, such as granules which land on top of other granules instead of the tacky asphalt coating. The sheet 13 then passes over a slate drum 21 which presses the granules into the tacky asphalt coating and inverts the sheet sufficiently for non-adhering granules to fall into a hopper 22.

Preferably, the hopper recycles the blend of non-adhering granules by discharging them back onto the sheet as background granules 23. However, the background granules can also be supplied separately and discharged from another hopper onto the sheet. The background granules can be a blend of the granules used to form the pattern of granule deposits on the sheet, or they can be a different kind of granules. Optionally, any of the granules can also be used as headlap granules. A pattern of granule deposits could also be formed on an asphalt coated sheet without applying background granules. In some methods, background granules are applied to portions of the sheet before applying the granule deposits.

In the illustrated embodiment, the background granules 23 adhere to the tacky asphalt coating in the areas of the sheet not covered by the granule deposits 20. From the drum 21, the sheet 13 passes through a conventional cooling section (not shown) and a cutter 24 which cuts the sheet into individual shingles 25.

Any type of granule applicator can be used for discharging the blend drops. Preferably, the granule applicator is adapted for ejecting the blend drops toward the sheet. By "eject", as used herein, is meant that the flow of granules is discharged toward the sheet by a force greater than the force of gravity. The flow of granules is forcefully propelled toward the sheet, preferably relatively rapidly. Ejecting the flow of granules from the granule applicator onto the sheet allows a desired shape of granule deposit to be obtained when the sheet is moving rapidly. If the flow of granules is dropped by gravity alone under such conditions, the resulting granule deposit may be undesirably elongated. The flow of granules can be ejected by any means, such as mechanically or electrostatically, but preferably the flow of granules is ejected pneumatically as described below.

Figure 3:
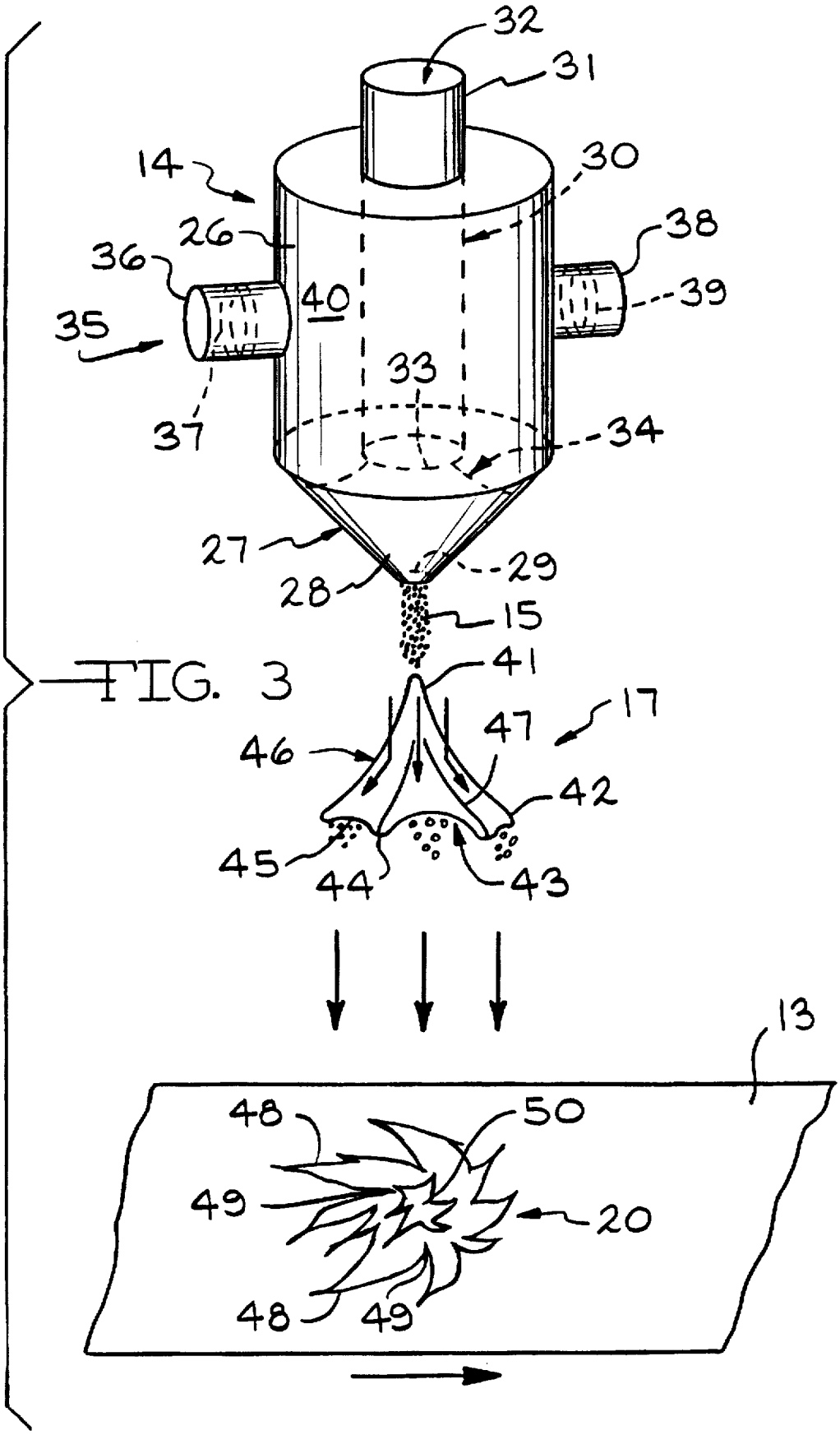
FIG. 3 is a perspective view of a pneumatic blend drop applicator for discharging a blend drop of granules, and a deflector having an irregular surface for deflecting the granules onto an asphalt coated sheet to form an irregular pattern according to the invention.

As shown in FIG. 3, a specially designed pneumatic blend drop applicator is a preferred granule applicator for use in ejecting the blend drops. The pneumatic blend drop applicator includes a hollow, generally cylindrical housing 26. A hollow nozzle 27 is provided at the lower end of the housing. The nozzle may be replaceable or formed integrally with the housing. Preferably, the nozzle is generally conical in shape, including a tip portion 28. An orifice 29 is formed in the tip portion of the nozzle for discharging a blend drop 15 of granules. Preferably, the orifice is generally circular in shape, but the shape of the orifice can be changed to affect the shape of the granule deposits on the sheet.

A granule feed chamber 30 is mounted inside the housing 26. Preferably, the granule feed chamber is a generally cylindrical tube. The granule feed chamber includes an input end 31 positioned near the upper end of the housing. Granules 32 are supplied from any source (not shown) into the input end of the granule feed chamber. The granule feed chamber also includes an output end 33. The granules are fed through the output end of the granule feed chamber into the nozzle 27. The granules form a pile or accumulation 34 of granules in the nozzle.

The pneumatic blend drop applicator 14 also includes a pneumatic gating mechanism, indicated generally at 35. The pneumatic gating mechanism includes a pressure port 36 for the inflow of pressurized air from any type of pressurized air source (not shown). A pressure solenoid valve 37 is positioned inside the pressure port for opening and closing the pressure port in order to start and stop the inflow of pressurized air. The pressurized air flows inside the hollow cylindrical housing 26 and into the nozzle 27 of the pneumatic blend drop applicator. The controller 16 is connected to the pressure solenoid valve to control the opening and closing of the pressure port.

The pneumatic gating mechanism also includes a vacuum port 38 for the outflow of air from the housing 26. The vacuum port is connected to any type of vacuum source (not shown) for applying a vacuum. A vacuum solenoid valve 39 is positioned inside the vacuum port for opening and closing the vacuum port in order to start and stop the vacuum. The controller 16 is connected to the vacuum solenoid valve to control the opening and closing of the vacuum port. The pressure solenoid valve and vacuum solenoid valve can be positioned at any location suitable for starting and stopping the air pressure and vacuum, respectively.

The interior of the housing 26 defines a buffer chamber 40 between the pressure port 36 and the vacuum port 38. The buffer chamber is positioned adjacent to the accumulation 34 of granules in the nozzle 27. In operation, when the pressure port is turned on and the vacuum port is turned off, pressurized air flows into the buffer chamber and increases the air pressure within the chamber. The force of the increased air pressure and gravity on the accumulation 34 of granules ejects a blend drop 15 of granules through the orifice 29 of the nozzle 27. The air pressure can also be adjusted to vary the flow rate of the granules, and thus the amount of granules which are ejected in the blend drop. For example, the flow rate may be adjusted so that the granule deposits look the same at different speeds of the sheet.

When the pressure port 36 is turned off and the vacuum port 38 is turned on, the air pressure in the buffer chamber 40 is reduced. As a result, air flows from outside the pneumatic blend drop applicator 14 through the orifice 29 and upward through the accumulation 34 of granules in the nozzle 27. The upward flow of air provides an upwardly oriented drag force on the granules in contrast to the downward pull of gravity on the granules. The proper amount of vacuum is applied to the buffer chamber so that the drag force from the upward flow of air balances the pull of gravity on the granules. This holds the granules in place and stops the downward flow of granules from the nozzle. By quickly cycling the pressure and vacuum valves 37, 39, different shapes and lengths of blend drops 15 can be achieved to produce different shapes of granule deposits.

If too much vacuum is applied so that the upward velocity of the air flow through the accumulation of granules exceeds a critical level, then the granules could become fluidized and begin to move as if they were caught in a fluid medium. The fluidization of the granules within the nozzle could create undesirable churning and mixing, or the granules could be pulled through the vacuum port. Consequently, the amount of vacuum is balanced to stop the flow of granules without causing fluidization.

After being ejected from the pneumatic blend drop applicator 14, the blend drop 15 is deflected with a deflector 17. In the embodiment shown, the granules of the blend drop are deflected radially outward so that the blend drop is spread by the deflector. The granules are typically deflected at an angle from vertical between about 5° and about 60°.

The shape of the deflector will affect the shape of the granule deposit formed on the sheet. Preferably, the deflector is generally conical in shape. The deflector 17 shown in FIG. 3 is generally conical in shape and appears generally in the shape of a duck's foot. The deflector includes an upper tip portion 41 and a lower base portion 42. The deflector has an irregular surface in the form of an irregular circumferential edge 43 around the base portion. The irregular edge is generally scalloped in shape, including alternating projections 44 and indentations 45. The deflector has another irregular surface in the form of a side surface 46 with irregular features. The irregular features of the side surface are a series of vertically extending ribs or ridges 47 spaced circumferentially around the deflector.

The granules of the blend drop 15 are deflected by the deflector 17 onto the sheet 13. Because of the irregular edge 43 and the ridges 47 of the deflector, the granules are deflected to form a granule deposit 20 on the sheet having an irregular pattern. Specifically, the granule deposit is shaped generally as a starburst pattern, including a series of alternating circumferentially spaced projections 48 and indentations 49. The granule deposit includes an inner portion 50 without granules.

As described above, a deflector for use in the present invention has an irregular surface so that it will deflect the flow of granules in an irregular pattern. The "irregular surface" can be an irregular edge or a surface with irregular features. The deflector 17 shown in FIG. 3 has both an irregular edge 43 and a surface 46 with irregular features 47. The irregular surface of the deflector of the present invention differs from the regular surfaces of previously known deflectors.

The irregular surface can be characterized by its curvature. If one follows the outline of an irregular surface, the direction of curvature changes. In the deflector 17 shown in FIG. 3, the direction of curvature of the irregular edge 43 changes from inward when approaching the indentations 45 to outward when approaching the projections 44. By contrast, the direction of curvature of a regular edge does not change. For example, a circular edge has a constant inward direction of curvature.

Preferably, the irregular surface includes alternating indentations and projections. The indentations and projections can be uniform or nonuniform. In FIG. 3, the indentations 45 and projections 44 of the deflector 17 are relatively uniform. In one nonlimiting embodiment of the invention, the projections extend outward from the indentations by at least about 2 millimeters, and preferably by at least about 6 millimeters.

In other words, the irregular surface is a non-smooth flow controlling surface that provides a significant difference or variation in the flow of the granules, so that the granules deposited onto one portion of the sheet are deflected differently from those deposited onto another portion. Usually, the granules are deflected differently in various circumferentially spaced positions around the deflector.

The "irregular pattern" of the granule deposit has an irregular edge which is defined in the same way as the irregular surface of the deflector. Preferably, the irregular edge includes alternating indentations and projections which can be uniform or nonuniform.

Figure 4:
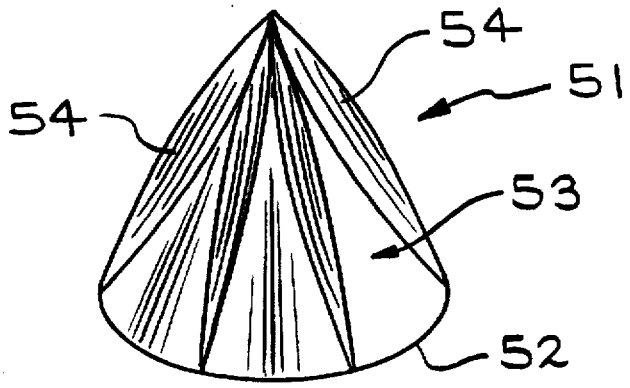
FIG. 4 is a perspective view of an alternate embodiment of a deflector according to the invention, the deflector having a regular edge but having a surface with irregular features.
Figure 5:
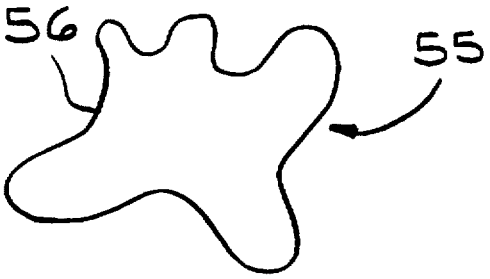
FIG. 5 is a plan view of another alternate embodiment of a deflector according to the invention, the deflector having the shape of a plate with an irregular edge.
Figure 6:
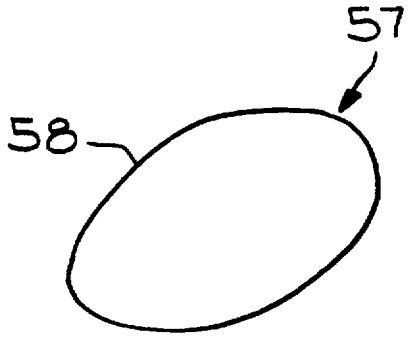
FIG. 6 is a plan view of a deflector unsuitable for use in the invention having the shape of a plate with a regular edge.

As shown in FIG. 4, a deflector 51 for use in the invention can include a regular edge 52 but an irregular surface in the form of a side surface 53 with ribs or ridges 54. As shown in FIG. 5, another deflector 55 for use in the invention can be a plate having an irregular edge 56. As shown in FIG. 6, a deflector 57 is unsuitable for use in the invention because it has a regular edge 58.

Figure 7:
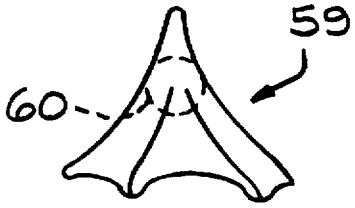
FIG. 7 is a perspective view of another alternate embodiment of a deflector according to the invention, the deflector being expandable for changing its shape.
Figure 8:
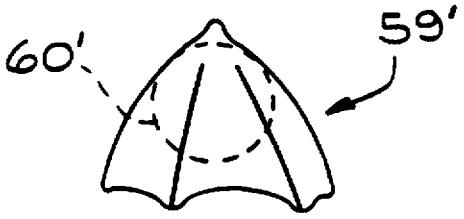
FIG. 8 is a perspective view of the deflector of FIG. 7 after it has been expanded to change its shape.

The deflector can be adapted for changing its shape in order to change the shape of the resulting granule deposit. As shown in FIG. 7, the deflector 59 can be formed of an elastomeric material so that it can expanded to change its shape. Any means can be used for expanding the deflector, such as an air bladder 60 connected to a source of air (not shown). FIG. 8 shows the deflector 59' after it has been expanded by expanding the air bladder 60'. In the embodiment shown, the deflector 59 appears generally in the shape of a duck's foot before expansion, and the deflector 59' appears generally in the shape of an umbrella after expansion. The deflector can be contracted to resume its original shape.

Many other structures can also be provided for changing the shape of the deflector. The surface of the deflector may have different portions which can move inward or outward separately and different distances in response to electronic signals. The deflector can be adapted for automatically changing its shape, or it can be responsive to signals for changing its shape.

The deflector is mounted in any suitable manner between the granule applicator and the sheet. For example, the deflector can be mounted on one end of a connecting rod, the other end of which is attached to the granule applicator. Preferably, the deflector is positioned relatively close to the orifice of the granule applicator. The relative positions of the granule applicator, the deflector and the sheet can all be varied to affect the shape and size of the resulting granule deposit.

The deflector can be mounted in a stationary position relative to the granule applicator, or it can be mounted to allow relative movement between the deflector and the granule applicator. The relative movement can occur during the deflection of a blend drop to vary the deflection of the granules, or it can occur between blend drops. The relative movement can be vertical, horizontal, rotational, or any combination thereof. For example, the deflector could be moved vertically to affect the size and shape of the granule deposit. The deflector could be moved horizontally so that the granules are deflected differently on different portions of the deflector.

Figures 9, 10:
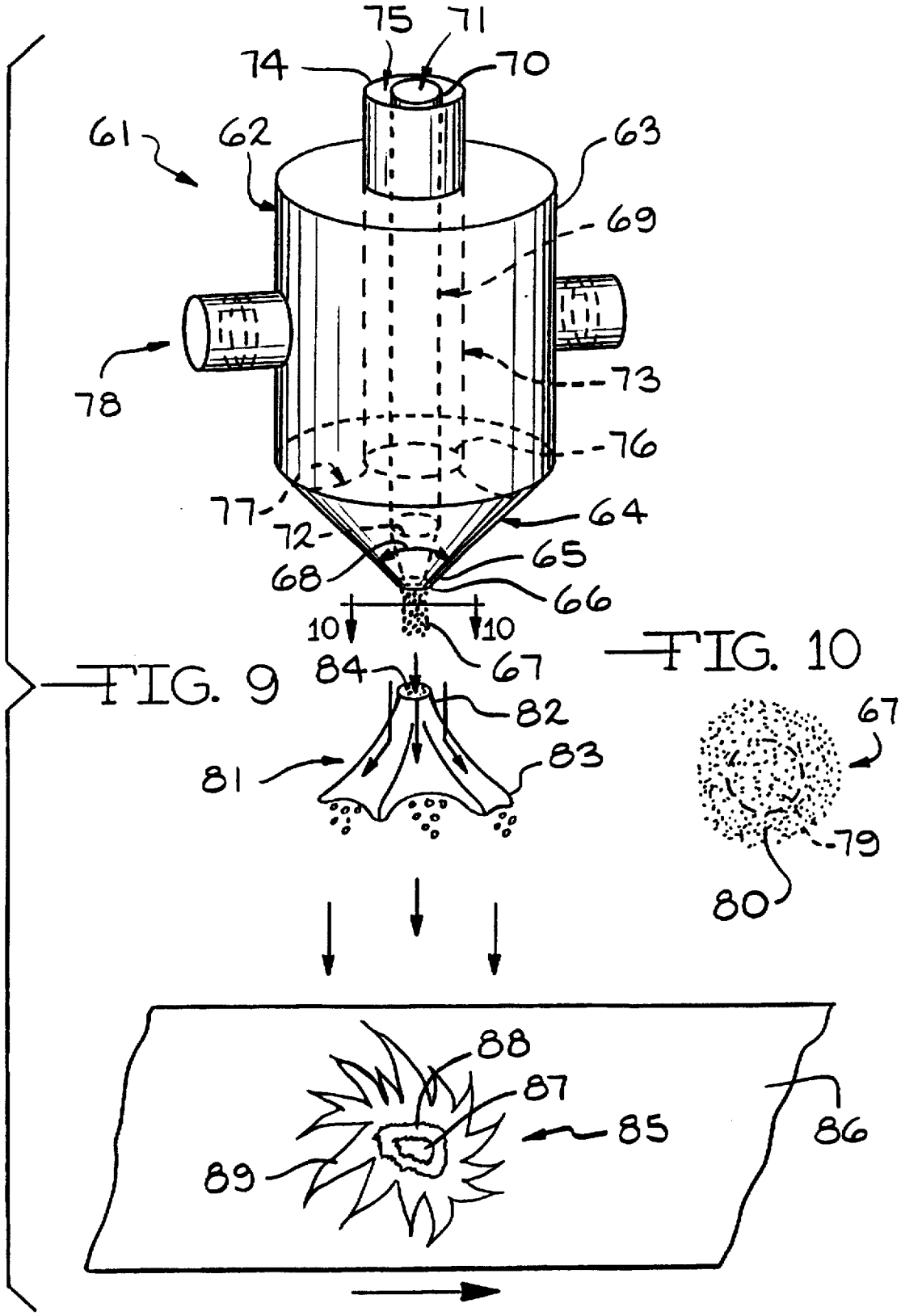
FIG. 9 is a perspective view of an alternate embodiment of a pneumatic blend drop applicator for discharging a blend drop of first and second granules, and a deflector having an opening for passage of the first granules and an irregular surface for deflecting the second granules, to form an irregular pattern on an asphalt coated sheet according to the invention.
FIG. 10 is a cross-sectional view of the blend drop taken along line 10—10 of FIG. 9, showing an inner portion of first granules and an outer portion of second granules.

FIG. 9 illustrates apparatus 61 for forming a granule deposit from two different kinds of granules according to the invention. A pneumatic blend drop applicator 62 includes a hollow, generally cylindrical housing 63. A hollow nozzle 64 is provided at the lower end of the housing. Preferably, the nozzle is generally conical in shape, including a tip portion 65. An orifice 66 is formed in the tip portion of the nozzle for discharging a blend drop 67 of first and second granules. The tip portion of the nozzle defines an angle 68 which is preferably between about 40° and about 140°, and more preferably between about 40° and about 70°. The angle of the tip portion can affect the shape of the granule deposit. Preferably, the nozzle is replaceable to facilitate changing the shape of the orifice or the angle of the tip portion.

A first granule feed chamber 69 is mounted inside the housing.

Preferably, the first granule feed chamber is a generally cylindrical first tube. The first granule feed chamber includes an input end 70 positioned near the upper end of the housing. First granules 71 are supplied from any source (not shown) into the input end of the first granule feed chamber. The first granule feed chamber also includes an output end 72. The first granules are fed through the output end of the first granule feed chamber into the nozzle 64.

A second granule feed chamber 73 is also mounted inside the housing. Preferably, the second granule feed chamber is a generally cylindrical second tube. The second granule feed chamber includes an input end 74 positioned near the upper end of the housing. Second granules 75 are supplied from any source into the input end of the second granule feed chamber. The second granule feed chamber also includes an output end 76. The second granules are fed through the output end of the second granule feed chamber into the nozzle 64.

The first granule feed chamber 69 and the second granule feed chamber 73 are positioned so that the first granules 71 are fed inside the second granules 75 in the nozzle 64. In the illustrated embodiment, the first granule feed chamber is positioned inside the second granule feed chamber. Preferably, the first granule feed chamber is generally coaxial with the second granule feed chamber. The first granules and second granules form a pile or accumulation 77 of granules in the nozzle.

The pneumatic blend drop applicator 62 also includes a pneumatic gating mechanism, indicated generally at 78. The pneumatic gating mechanism includes the same structures and operates in the same manner as the pneumatic gating mechanism 35 of the pneumatic blend drop applicator 14 illustrated in FIG. 3. In operation, when the pressure port is turned on and the vacuum port is turned off, a blend drop 67 of first and second granules 71, 75 is ejected through the orifice 66 of the nozzle 64. As shown in FIG. 10, the blend drop 67 is generally circular in cross section and includes an inner portion 79 of first granules 71 and an outer portion 80 of second granules 75.

After being ejected from the pneumatic blend drop applicator 62, the blend drop 67 is deflected with a deflector 81.

The deflector is similar to the deflector 17 illustrated in FIG. 3, including an upper tip portion 82 and a lower base portion 83. However, the deflector is hollow and includes an opening 84 in the tip portion. The opening allows the first granules 71 to pass through the deflector while the second granules 75 are deflected by the irregular surfaces of the deflector. The granules form a granule deposit 85 on the sheet 86 having an irregular pattern. Specifically, the granule deposit is shaped generally as a starburst pattern. The pattern includes an inner portion 87 of first granules 71, a ring 88 of background granules surrounding the inner portion, and an outer portion 89 of second granules 75.

The first granules and second granules for use in the invention can be any kind of granules, such as roofing granules, that are different from one another in some manner. Some of the possible differences include: different color, different size, different shape, different type of granule (e.g., different types of natural rock granules, or natural rock granules and ceramic coated granules), different resistance to microorganisms, different aging properties, or different shading properties. Preferably, the first and second granules are different in color. More than two different kinds of granules can also be used in the invention. The different granules can be adjacent or spaced apart in the granule deposit.

As shown in FIGS. 11 through 13, the method and apparatus of the invention can include a shield 90 along with the deflector 17. The illustrated shield is generally frusto-conical in shape, but other shapes can be used to change the shape of the resulting granule deposit. A blend drop 91 of granules is deflected by the deflector. The deflected granules are controlled by the shield. The shield has an inner surface 92 for controlling the granules, in contrast with the irregular outer edge 43 of the deflector for deflecting the granules. Preferably, the inner surface of the shield has an irregular opening 93 for controlling the granules. The illustrated opening defines a generally sawtooth edge, although any irregular edge can be used. The irregular edge includes indentations 94 and projections 95 which can be uniform or non-uniform.

The opening 93 of the shield 90 is positioned around the irregular edge 43 of the deflector 17. In a preferred embodiment, the opening of the shield is positioned generally even with the irregular edge of the deflector. Typically, the opening of the shield will be positioned within about 3 centimeters up or down from the irregular edge of the deflector. The deflector and shield are sized so that the deflector fits inside the shield with a relatively small amount of clearance therebetween.

The granules are deflected onto the sheet 96 to form a sunburst pattern 97 having alternating circumferentially spaced projections 98 and indentations 99. The pattern has an inner portion 100 without granules.

Figure 14:
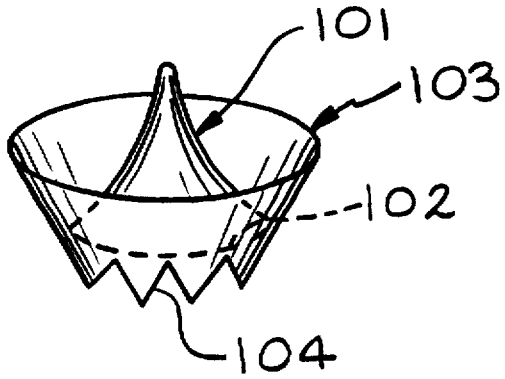
FIG. 14 is a perspective view of an alternate embodiment of the invention, in which a deflector having a regular surface is positioned inside a shield having an irregular opening to form an irregular pattern of granules on an asphalt coated sheet.

FIG. 14 illustrates an embodiment of the invention in which a deflector 101 having regular surfaces including a regular edge 102 is used with a shield 103 having an irregular opening 104.

Figure 15:
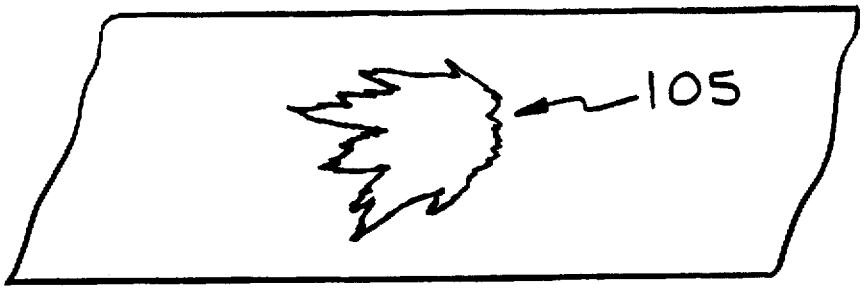
FIG. 15 is a leaf-shaped pattern according to the invention.
Figure 16:
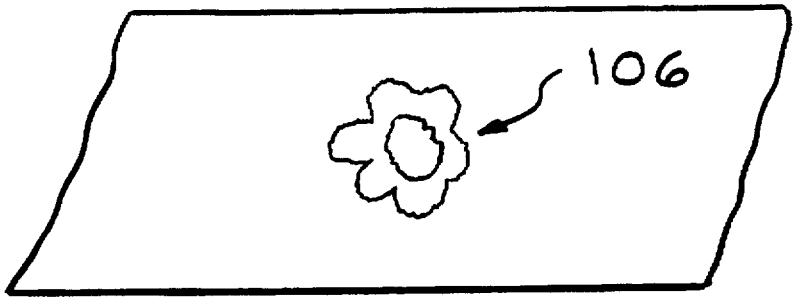
FIG. 16 is a flower-shaped pattern according to the invention.

Many different types of irregular patterns can be formed according to the method of this invention. FIG. 15 illustrates a leaf-shaped pattern 105 according to the invention. FIG. 16 illustrates a flower-shaped pattern 106.

It should be understood that, although the method of the invention has been described in relation to preferred granule applicators, any other type of granule applicator suitable for discharging a flow of granules toward the sheet can be used. Although the illustrated embodiment includes three granule applicators, any desired number can be used (e.g., from one to four or more). The nozzle of the granule applicator can be generally linear or elongated in shape, instead of generally conical. Any suitable size and shape of orifice can be used for discharging the flow of granules. The deflector can be any shape having an irregular edge or a surface with irregular features. For example, the deflector can be elongated instead of generally conical.

The principle and mode of operation of this invention have been described in its preferred embodiment. However, it should be noted that this invention may be practiced otherwise than as specifically illustrated and described without departing from its scope.

We claim:

1. A method of forming an irregular pattern of granules on an asphalt coated sheet comprising:

discharging a flow of granules toward the asphalt coated sheet, and deflecting the flow of granules onto the asphalt coated sheet with a deflector having a surface with changes in the direction of curvature to provide a non-uniform flow of granules so as to form on the asphalt coated sheet a granule deposit having an irregular pattern.

2. The method according to claim 1 wherein the sheet is moving and the flow of granules is ejected toward the sheet.

3. The method according to claim 1 wherein the surface of the deflector includes an edge having indentations and projections.

4. The method according to claim 1 wherein the deflector is generally conical in shape.

5. The method according to claim 1 wherein the deflector has an opening allowing first granules to pass through an opening in the deflector while second granules are deflected by the surface of the deflector.

6. The method according to claim 5 wherein the flow of granules is discharged so that first granules pass through the opening in the deflector while second granules are deflected by the deflector.

7. The method according to claim 1 wherein the shape of the deflector is changed while deflecting the granules onto the sheet.

8. The method according to claim 1 wherein the irregular pattern is a starburst pattern.

9. The method according to claim 1 wherein the distribution diameter of the deflected granules is controlled with a shield positioned around the deflector.

10. The method according to claim 9 wherein the shield has a surface with an irregular opening for controlling the distribution shape and diameter of the deflected granules.

11. The method according to claim 10 wherein the irregular opening of the shield is positioned generally around the irregular surface of the deflector.

12. The method according to claim 3 wherein the edge formed by the indentations and projections is a scalloped edge.

13. The method according to claim 1 wherein the deflector is shaped generally like a duck's foot.

14. A method of forming an irregular pattern of granules on an asphalt coated sheet comprising:

discharging a flow of granules toward the asphalt coated sheet, deflecting the flow of granules onto the asphalt coated sheet with a deflector, and controlling the distribution shape and distribution diameter of the granules with a shield positioned around the deflector, the shield having a surface with an opening defined by an edge having indentations and projections, to form a granule deposit on the asphalt coated sheet having an irregular pattern.

15. The method according to claim 14 wherein the sheet is moving and the flow of granules is ejected toward the sheet.

16. An apparatus for forming an irregular pattern of granules on an asphalt coated sheet comprising:

a granule applicator for discharging a flow of granules toward the sheet, and a deflector for deflecting the granules onto the sheet, the deflector having a surface with changes in the direction of curvature to provide a non-uniform flow of granules so as to form a granule deposit having an irregular pattern.

17. The apparatus of claim 16 wherein the surface of the deflector includes an edge having indentations and projections.

18. The apparatus of claim 16 wherein the deflector has an opening allowing some granules to pass through the deflector while other granules are deflected by the surface of the deflector.

19. The apparatus of claim 16 additionally comprising a shield for controlling the distribution diameter of the granules.

20. The apparatus of claim 19 wherein the shield has a surface with an opening defined by an edge having indentations and projections for controlling the distribution shape and diameter of the granules.

* * * * *